US005834167A

United States Patent [19]

Lussier et al.

[11] Patent Number: 5,834,167

[45] **Date of Patent: *Nov. 10, 1998**

[54] PHOTOGRAPHIC ELEMENT CONTAINING YELLOW DYE-FORMING COUPLER COMPRISING A DYE LIGHT STABILITY ENHANCING BALLAST AND PROCESS

[75] Inventors: Barbara B. Lussier; John DiCillo, both of Rochester, N.Y.

[73] Assignee: Eastman Kodak Company, Rochester, N.Y.

[ * ] Notice: The term of this patent shall not extend beyond the expiration date of Pat. No. 5,677,114.

[21] Appl. No.: 881,840

[22] Filed: Jun. 25, 1997

Related U.S. Application Data

[63] Continuation-in-part of Ser. No. 680,743, Jul. 15, 1996, abandoned, which is a continuation-in-part of Ser. No. 565,517, Nov. 30, 1995, abandoned.

[51] Int. Cl.[6] ..... G03C 7/36; G03C 7/305

[52] U.S. Cl. ..... 430/389; 430/388; 430/544; 430/556; 430/557

[58] Field of Search ..... 430/557, 388, 430/389, 556, 544

[56] References Cited

U.S. PATENT DOCUMENTS 5,677,114 10/1997 Lussier et al. ..... 430/557

FOREIGN PATENT DOCUMENTS 56-030126 3/1981 Japan .
63-85631 4/1988 Japan ..... 430/557
63-97951 4/1988 Japan ..... 430/557

*Primary Examiner*—Richard L. Schilling
*Attorney, Agent, or Firm*—Arthur E. Kluegel

[57] ABSTRACT

A photographic element comprising a light sensitive silver halide emulsion layer having associated therewith an open chain α-carbonyl acetanilide yellow dye-forming coupler having the formula:

wherein $R_1$ is selected from the group consisting of alkyl, aryl, heterocyclic, and amino groups, provided that $R_1$ may form a ring bonded to another carbon atom which is a member of Ring "A";

each $R_2$ is independently selected from the group consisting of those substituents having a Hammett's sigma value of 0 or less, and m is from 0 to 4;

Ring "A" is bonded indirectly to the 3-, 4-, or 5-position of Ring "B";

Z is hydrogen, or a group capable of coupling-off when the coupler reacts with an oxidized color developing agent said coupling-off group selected from the group consisting of:

(a) an arylthio group;

(b) a heterocyclic group containing, in a five or six membered ring, one or two nitrogen atoms, wherein the group Z is bonded to the remainder of the coupler through a nitrogen atom in the ring; and (c) a benzotriazole group wherein the group Z is bonded to the remainder of the coupler through a nitrogen atom in the triazole group.

17 Claims, No Drawings

PHOTOGRAPHIC ELEMENT CONTAINING YELLOW DYE-FORMING COUPLER COMPRISING A DYE LIGHT STABILITY ENHANCING BALLAST AND PROCESS

CROSS-REFERENCE TO RELATED APPLICATIONS

This application is a continuation-in-part of U.S. Ser. No. 08/680,743, filed Jul. 15, 1996, now abandoned, which is in turn a continuation-in-part of U.S. Ser. No. 08/565,517 filed Nov. 30, 1995, now abandoned.

FIELD OF THE INVENTION

This invention relates to color photographic materials or elements comprising a yellow dye-forming coupler which forms a dye upon development which exhibits improved stability against dye fade.

BACKGROUND OF THE INVENTION

A typical photographic element contains multiple layers of light-sensitive photographic silver halide emulsions with one or more of these layers being spectrally sensitized to blue light, green light, and red light, respectively. The blue, green, and red light sensitive layers will typically contain yellow, magenta or cyan dye forming couplers, respectively.

For forming color photographic images, the color photographic material is exposed imagewise and processed in a color developer bath containing an aromatic primary amine color developing agent. Image dyes are formed by the coupling reaction of these couplers with the oxidized product of the color developing agent. Generally, image couplers are selected to provide image dyes with good stability towards heat and light and which desirably have an absorption curve with a suitable peak absorption and low unwanted side absorptions in order to provide color photographic images with good color reproduction.

The present invention is concerned with improving the light stability of yellow image dyes. Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Other examples of yellow dye-forming couplers are detailed in *Research Disclosure* No. 365, Item 36544, September 1994, Section X-B(6). Such couplers are typically open chain ketomethylene compounds.

The ability of yellow image dyes to resist fade is important to the longevity of color images, especially those which are destined to be subject to prolonged storage or constant daylight exposure such as professional portraits and the like. Yellow images will fade and images formed with yellow dye as a component may change color if the rate of fade for the yellow dye is not sufficiently matched with the other dyes of the photographic element.

Heretofore, one method of improving the light stability of yellow image dyes has been to add one or more stabilizing addenda to the coupler dispersion. Compounds suitable for this purpose are described more fully in *Research Disclosure* No. 365, Item 36544, September 1994, Section X-D. Examples of suitable such compounds are shown as Compounds 1, 2, and 3 and P1 in conjunction with Table IV.

U.S. Pat. No. 4,248,962 relates to a pyrazolotriazole magenta dye-forming coupler designed to release a photographically useful group upon coupling. The patent proposes a timing group which will undergo an intramolecular nucleophilic displacement reaction to release a photographically useful group. Among the many proposed couplers is one (coupler 44) which contains a ballast having an acetate substituent on a phenoxy group connected through a linking group to a phenyl ring in the ballast. There is no indication that any dye light stability is inferred by the presence of the particular ballast employed in that example.

A problem to be solved is to provide a yellow image dye-forming coupler which forms a dye upon development which exhibits improved stability including dark and light stability. Desirably, the coupler is one for which the stability may be further improved by the addition of a stabilizing addenda.

SUMMARY OF THE INVENTION

The invention provides a photographic element comprising a light sensitive silver halide emulsion layer having associated therewith an open chain α-carbonyl acetanilide yellow dye-forming coupler having the formula:

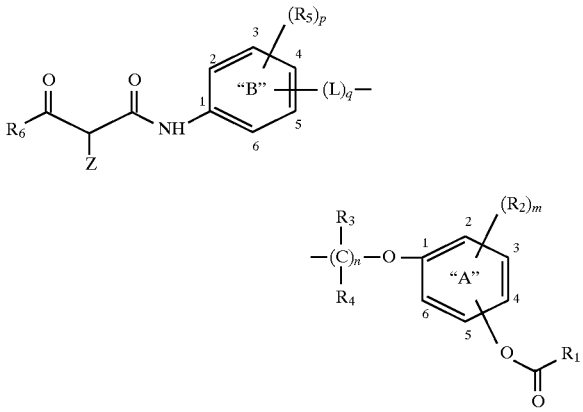

wherein $R_1$ is selected from the group consisting of alkyl, aryl, heterocyclic, and amino groups, provided that $R_1$ may form a ring bonded to another carbon atom which is a member of Ring "A";

each $R_2$ is independently selected from the group consisting of those substituents having a Hammett's sigma value of 0 or less, and m is from 0 to 4;

each $R_3$ and $R_4$ for each of the n carbon atoms is independently selected from the group consisting of hydrogen, alkoxy, aryl, heterocyclic, aryloxy, and alkyl groups, and n is 0 to 16;

each $R_5$ is independently selected from the group consisting of halogen, amino, alkyl groups, and groups linked to the "B" ring by oxygen or sulfur, and p is 0 to 3, provided that two $R_5$ groups may join to form a ring;

each L is independently a divalent linking group bonding the ballast group directly or indirectly to a noncoupling position of the rest of the coupler, L being selected from the group consisting of

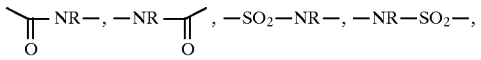

-continued

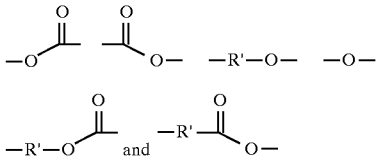

wherein R is hydrogen or an alkyl group and R' is an alkylene group and q is 0 to 3;

Ring "A" is bonded indirectly to the 3-, 4-, or 5-position of Ring "B";

$R_6$ is selected from the group consisting of alkyl, aryl, and amino groups; and Z is hydrogen, or a group capable of coupling-off when the coupler reacts with an oxidized color developing agent said coupling-off group selected from the group consisting of:

(a) an arylthio group;

(b) a heterocyclic group containing, in a five or six membered ring, one or two nitrogen atoms, wherein the group Z is bonded to the remainder of the coupler through a nitrogen atom in the ring; and (c) a benzotriazole group wherein the group Z is bonded to the remainder of the coupler through a nitrogen atom in the triazole group.

The photographic element of the invention forms a yellow image dye which exhibits improved stability.

DETAILED DESCRIPTION OF THE INVENTION

The element of the invention comprises a yellow coupler shown in the Summary of the Invention.

$R_1$ is the substituent attached to the acyloxy group on the ring "A". It may be an alkyl, aryl, heterocyclic, or an amino group. Also, $R_1$ may form a ring bonded to another carbon atom which is a member of Ring "A". Particularly suitable are alkyl (including cycloalkyl and branched alkyl), amino, fused alkyl, and aryl groups. Particularly suitable are methyl, isopropyl, fused alkyl, t-butyl, dimethylamino, diethylamino, phenyl, and fused amino.

Each $R_2$ is a substituent on the phenoxy ring "A", and there may be present up to four of these substituents. This substituent may be broadly selected from those substituents which have a Hammett's sigma value of 0 or less. Hammett's sigma values are provided in C. Hansch and A. J. Leo, "Substituent Constants for Correlation Analysis in Chemistry and Biology", Wiley, New York, N.Y., 1979. Generally, values less than 0 indicate that a substituent has an electron donating effect relative to hydrogen. Thus, $R_2$ is electron donating. It is further desirable that at least one $R_2$ group is located ortho to the acyloxy group containing $R_1$. Suitably, $R_2$ is an alkyl, alkoxy or amino compound. Satisfactory compounds include thioalkyl, dialkylamino, and branched alkyl and alkoxy groups. Appropriate examples include t-butyl, t-pentyl, t-octyl, and isopropyl.

Where n>1 the $R_3$ and $R_4$ substituents bonded to each of the n carbon atoms may be independently selected. Besides hydrogen, suitable $R_3$ and $R_4$ substituents may include alkyl, alkoxy (including polyalkoxy), aryl, aryloxy, heterocyclic, and amino groups. Alkyl or alkoxy groups of 1–18 carbon atoms and hydrogen are satisfactory substituents. If desired, $R_3$ or $R_4$ may form a ring with another $R_3$ or $R_4$ group.

$R_5$ is a substituent which may or may not be present as indicated by the subscript "p". Each $R_5$ is a substituent which may be a halogen, an amino group, an alkyl group, or a group linked to the "B" ring by an atom of oxygen or sulfur. Suitably, one or more of the $R_5$ substituents may occupy the 2-, 4-, or 6- position of the ring "B". Suitably, $R_5$ may be a halogen atom or may be bonded to the ring "B" by an acyloxy, alkylthio, alkyl, amino, or oxy group. Particularly suitable groups are alkylacyloxy, arylacyloxy, trifluoromethyl, alkylthio, alkoxy, aryloxy, alkyl, amino, fluorine, chlorine, bromine, or iodine. The value of "p" may range from 0 to 3.

$R_6$ may comprise an aliphatic or aromatic group. Suitably, $R_6$ may be an amino group, an alkyl group, a carbocyclic group, or heterocyclic group having an atom of nitrogen, sulfur, oxygen, or phosphorus in the ring. More suitably, $R_6$ may be a secondary or tertiary alkyl group, a phenyl group, a phenyl amino group, or an alkyl amino group. Typically, the secondary alkyl group may be an isopropyl group, the tertiary alkyl group may be t-butyl, t-pentyl, t-octyl, methylcyclopropyl, or adamantyl. The phenyl group may be phenyl or phenyl substituted, for example, with alkoxy, alkyl or amido groups. The heterocyclic ring may be a pyrolidino or indolino group and the amino may be a phenylamino or alkylamino group.

The group L is optionally present. As indicated by the value of q of up to three, there may be present as many as three L groups. Each of the L groups may be independently selected to provide a linkage between the ring "B" and the remainder of the ballast. In the broadest sense, L may be any divalent group linking the ballast directly or indirectly with a noncoupling position of the rest of the coupler. Each L may be represented, for example, by one of the groups:

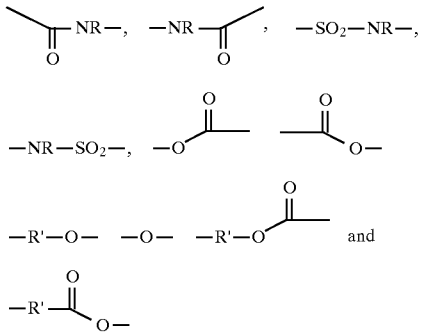

wherein R is hydrogen or an alkyl group and R' is an alkylene group. Specifically useful are:

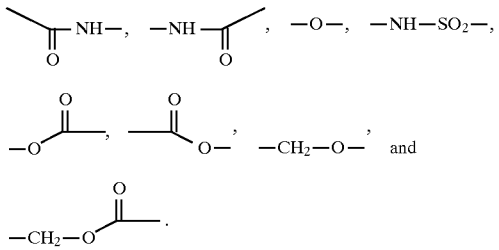

The group Z represents hydrogen or a particular coupling-off group which can be split from the coupler upon reaction with oxidized developer selected from the group consisting of:

(a) an arylthio group;

(b) a heterocyclic group containing, in a five or six membered ring, one or two nitrogen atoms, wherein the group Z is bonded to the remainder of the coupler through a nitrogen atom in the ring; and (c) a benzotriazole group wherein the group Z is bonded to the remainder of the coupler through a nitrogen atom in the triazole group.

If desired, the coupling-off group may include a so-called timing group together with a photographically useful group ("PUG") which can permit the PUG to diffuse away from the coupler's initial location to perform a function such as inhibiting development, assisting bleaching etc. Such groups are more fully described hereafter.

Examples of suitable couplers of the invention are as follows:

Y-1

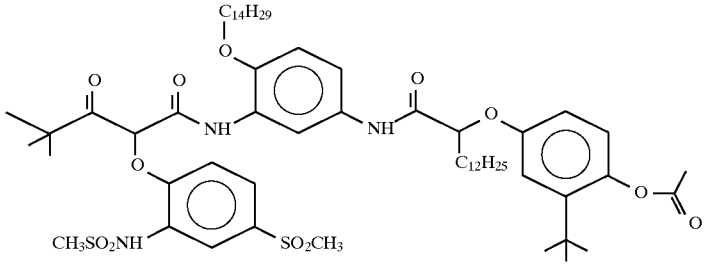

Y-2

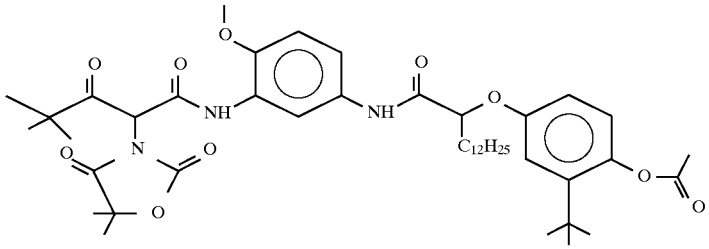

Y-3

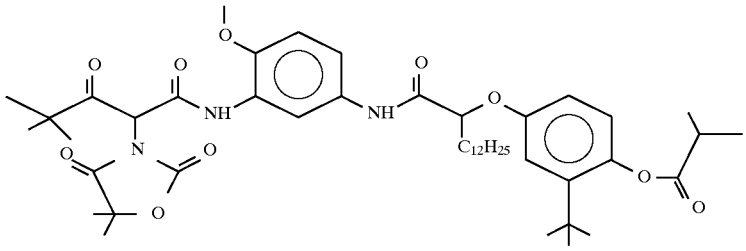

Y-4

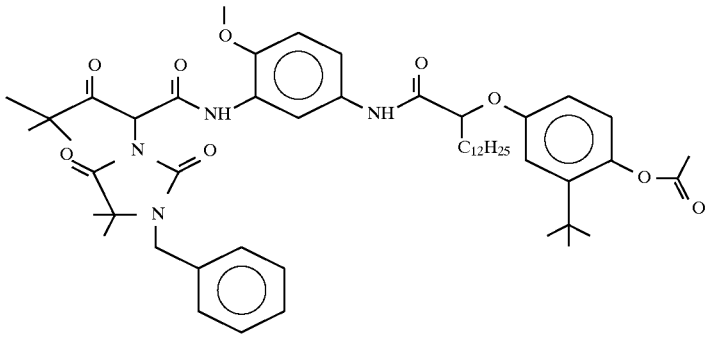

Y-5

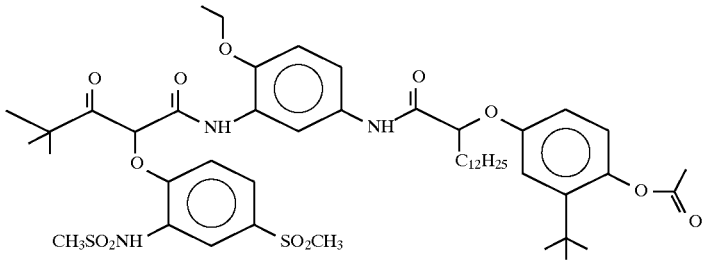

-continued
Y-6
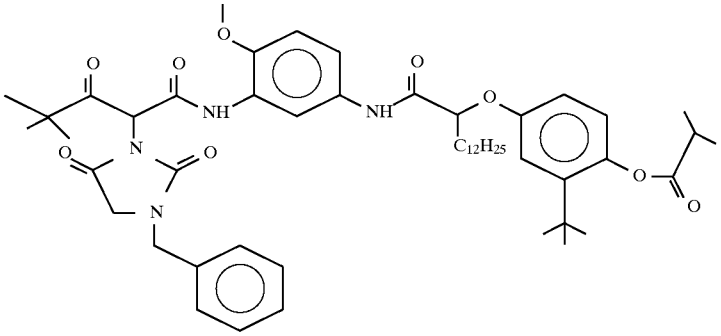
Y-7
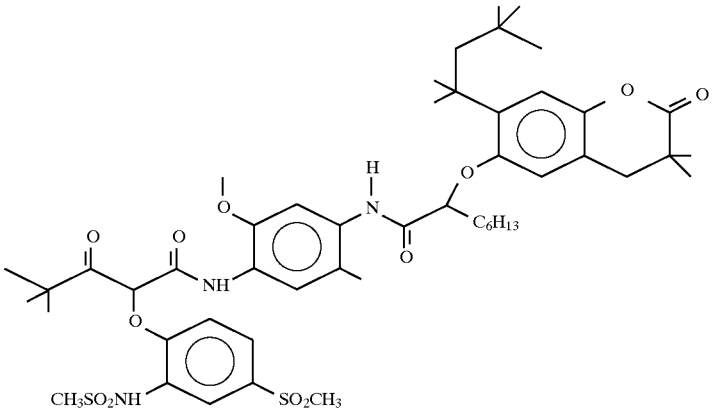
Y-8
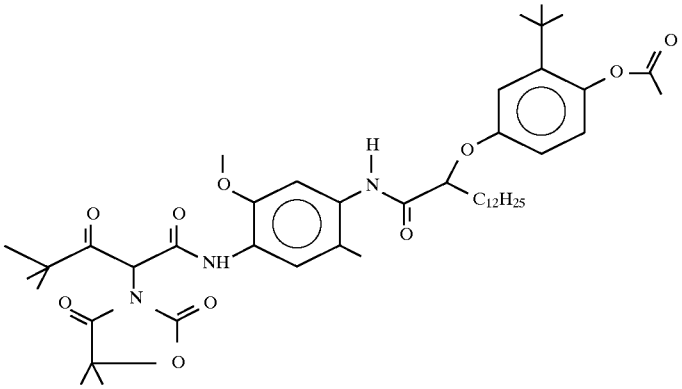
Y-9
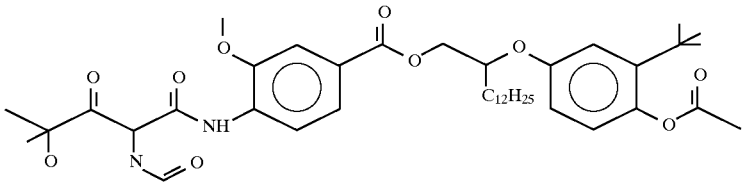

-continued
Y-10
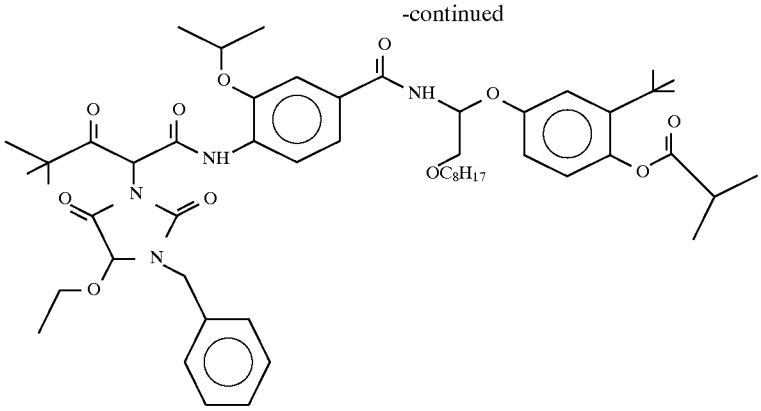
Y-11
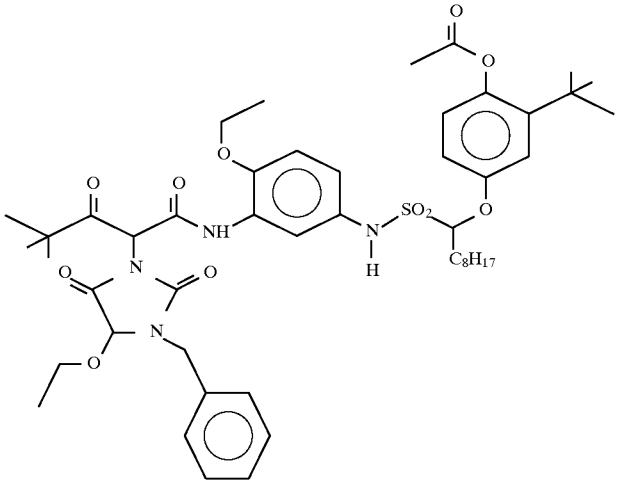
Y-12
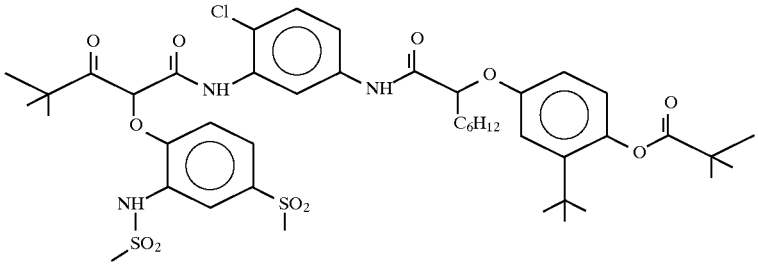
Y-13
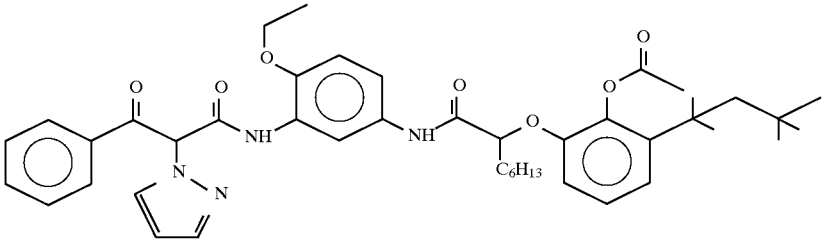
Y-14
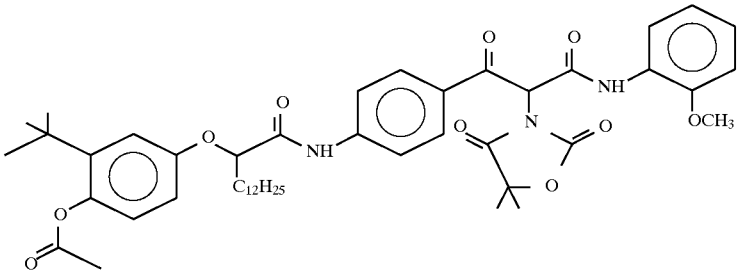

-continued
Y-15
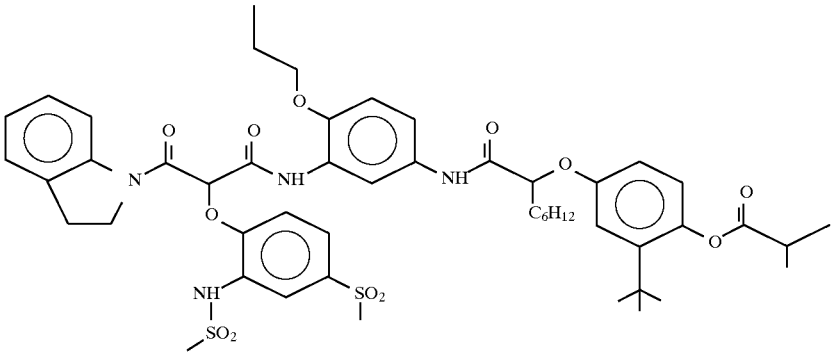
Y-16
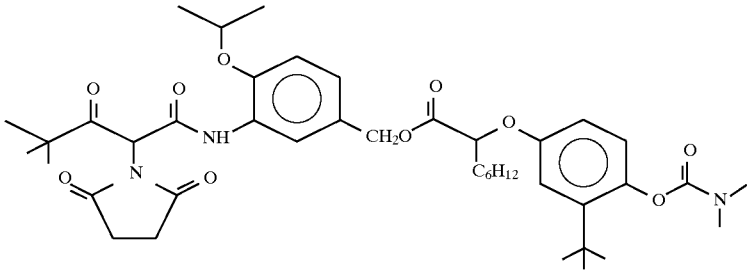
Y-17
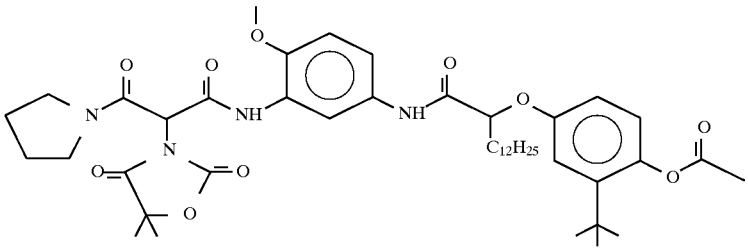
Y-18
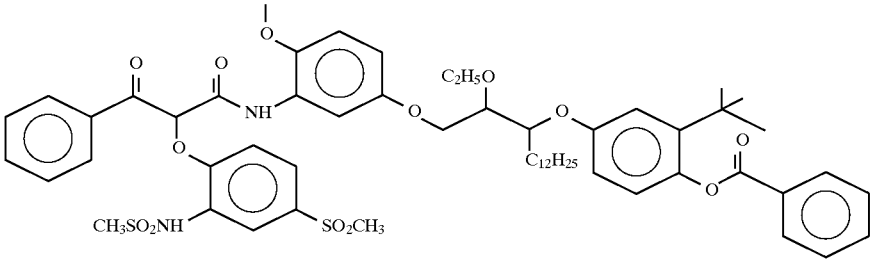
Y-19
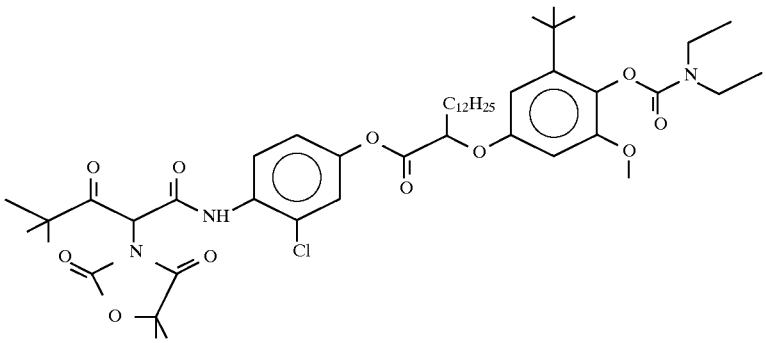

-continued
Y-20
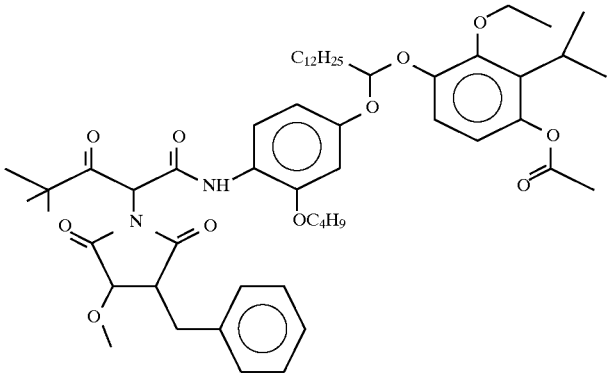
Y-21
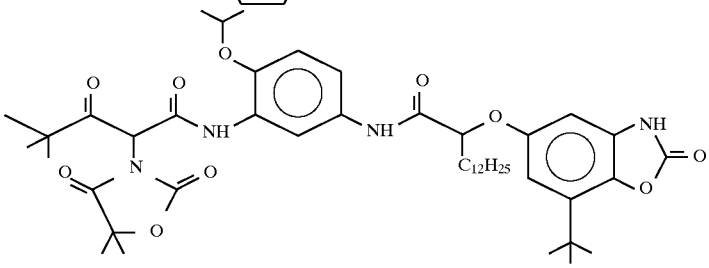
Y-22
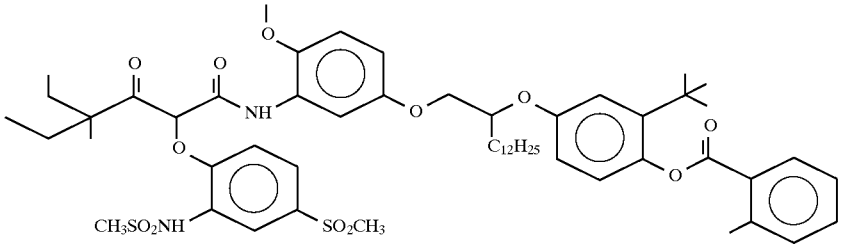
Y-23
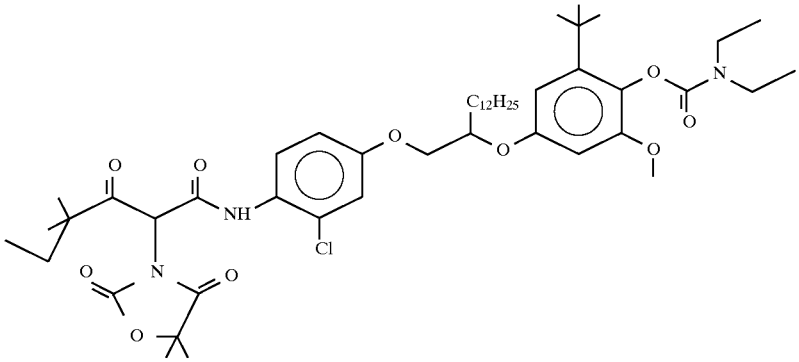
Y-24
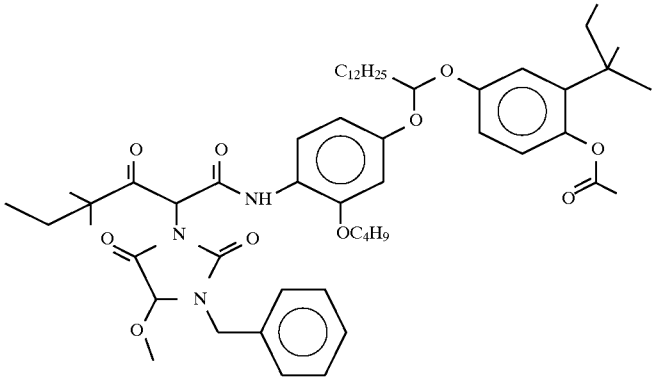

-continued
Y-25
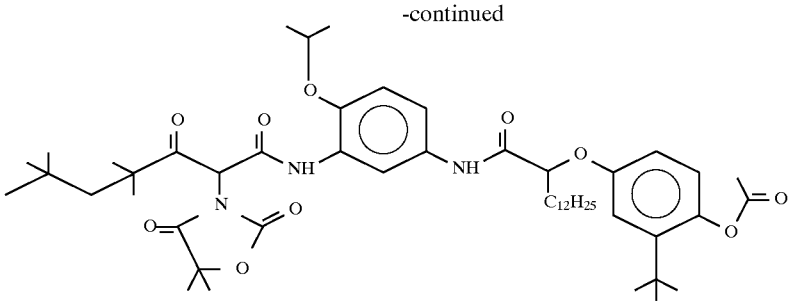
Y-26
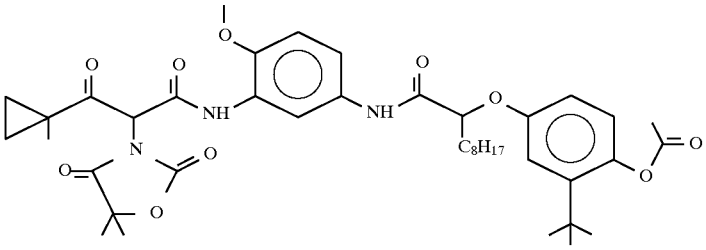
Y-27
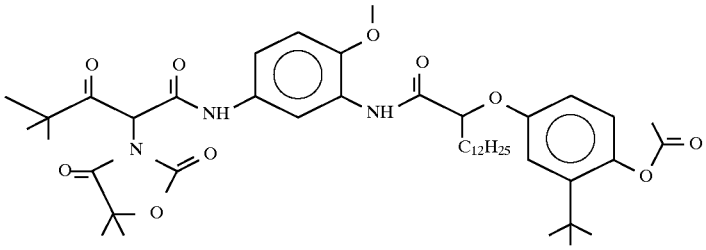
Y-28
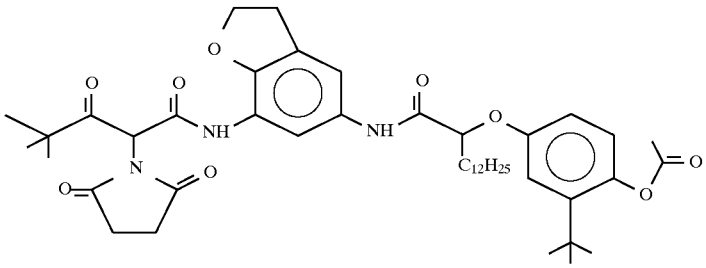
Y-29
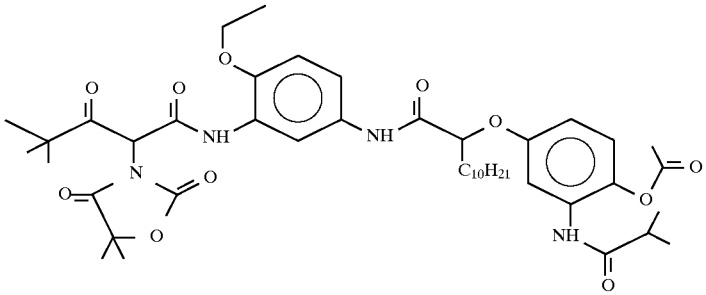
Y-30
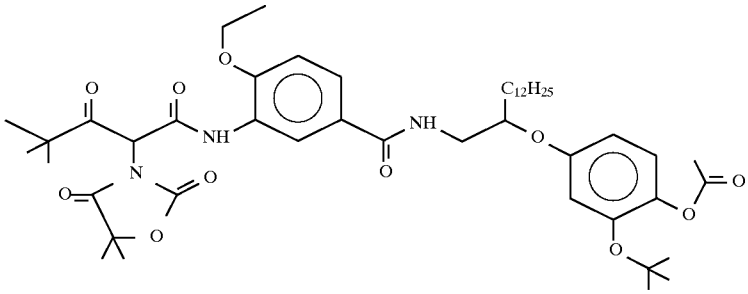

-continued

Y-31

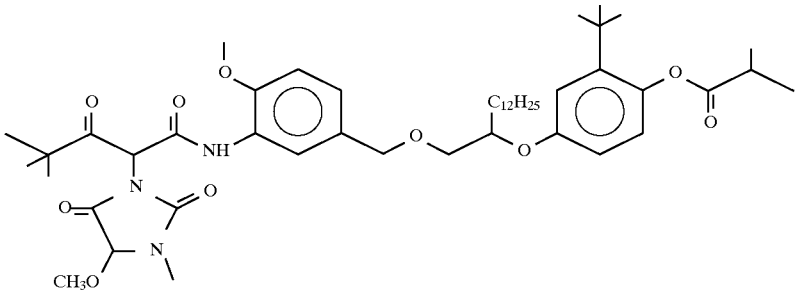

Y-32

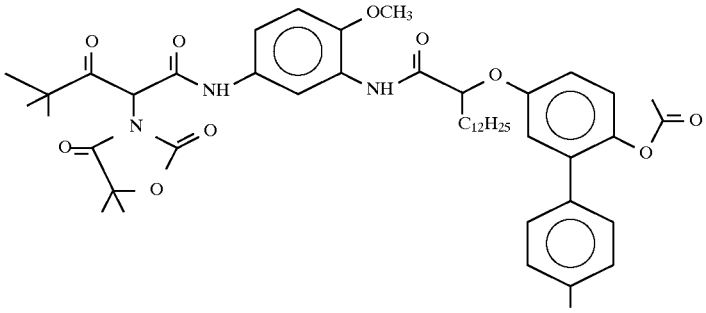

Y-33

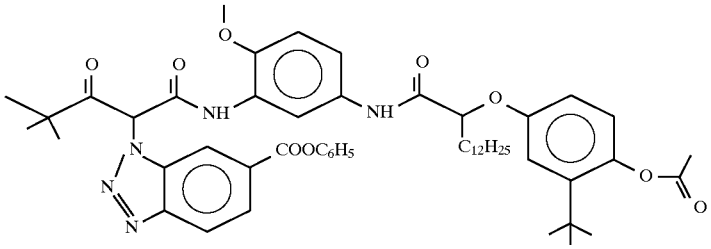

Y-34

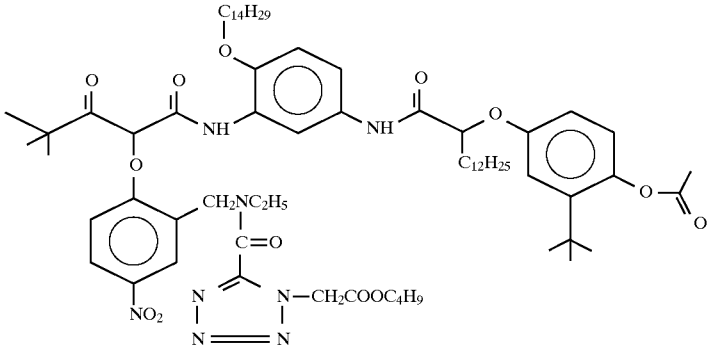

Y-35

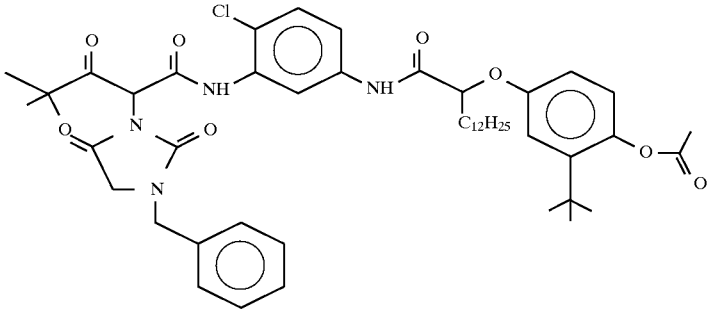

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl;

carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc.

Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in

*Research Disclosure*, November 1992, Item 34390 published by Kenneth Mason Publications, Ltd., Dudley Annex, 12a North Street, Emsworth, Hampshire P010 7DQ, ENGLAND, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps, particularly those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, heteroxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form colorless products upon reaction with oxidized color developing agent are described in such representative patents as: UK. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58–113935. The masking couplers may be shifted or blocked, if desired.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

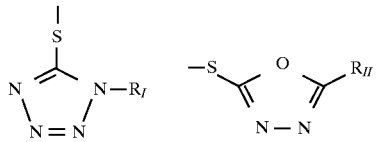

-continued

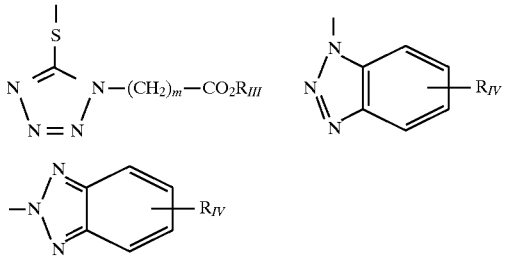

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group such as groups utilizing the cleavage reaction of a hemiacetal (U.S. Pat. No. 4,146,396, Japanese Applications 60-249148; 60–249149); groups using an intramolecular nucleophilic substitution reaction (U.S. Pat. No. 4,248,962); groups utilizing an electron transfer reaction along a conjugated system (U.S. Pat. No. 4,409,323; 4,421,845; Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

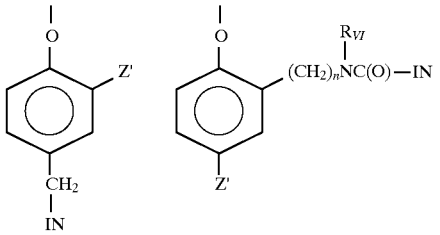

wherein IN is the inhibitor moiety, Z' is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1
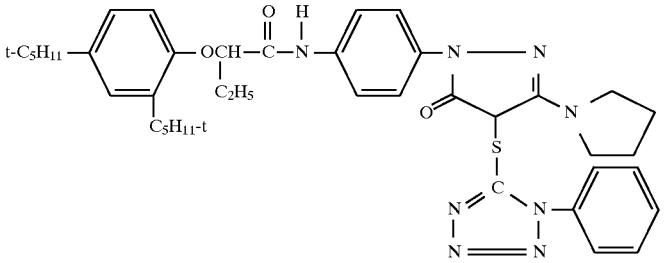
D2
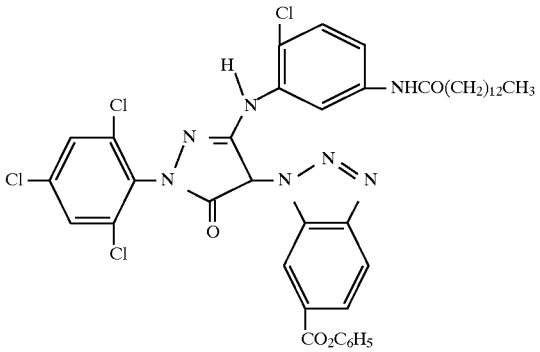
D3
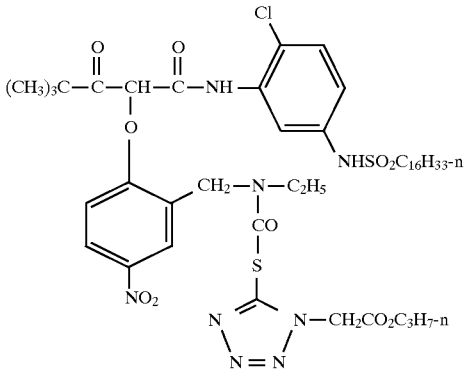
D4
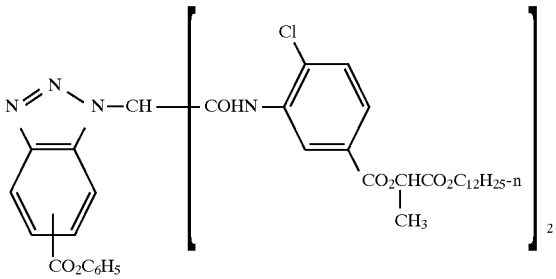
D5
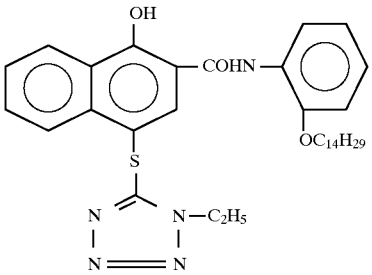

-continued
D6
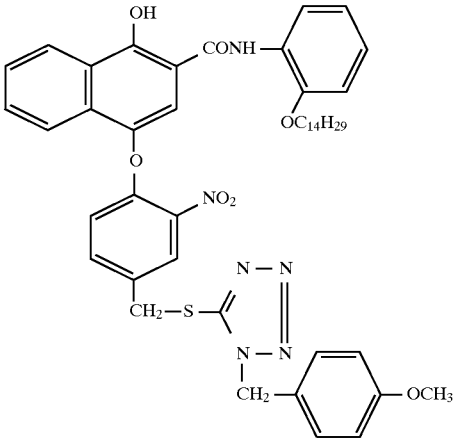
D7
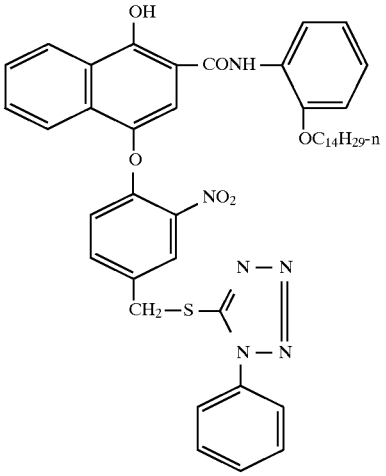
D8
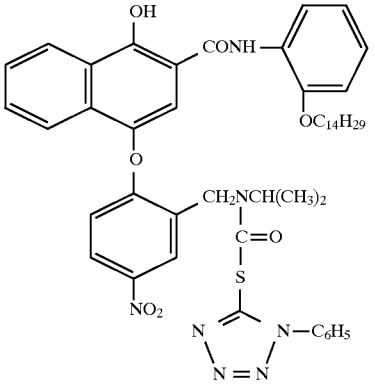

-continued

D9

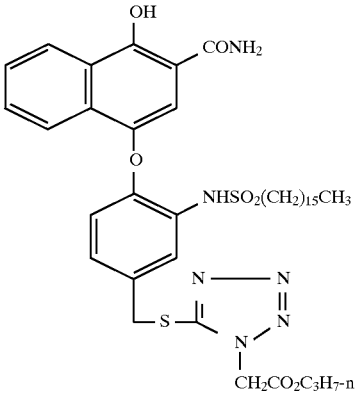

D10

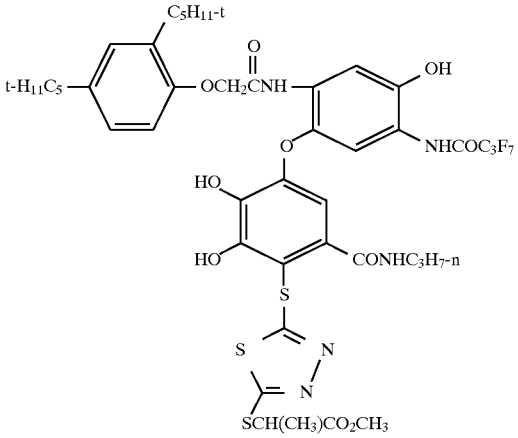

It is also contemplated that the concepts of the present invention may be employed to obtain reflection color prints as described in *Research Disclosure*, November 1979, Item 18716, available from Kenneth Mason Publications, Ltd. Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micrometer) tabular grains. To achieve the lowest levels of granularity it is preferred that aim tabular grain projected areas be satisfied with ultrathin ($t<0.06$ micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak C-41 color process as described in The British Journal of Photography Annual of 1988, pages 191–198. Where applicable, the element may be processed in accordance with color print processes such as the RA-4 process of Eastman Kodak Company as described in the British Journal of Photography Annual of 1988, Pp 198–199. Such negative working emulsions are typically sold with instructions to process using a color negative method such as the mentioned C-41 or RA-4 process. To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as E-6. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamido-ethyl)aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the various copending applications as well as patents and other publications cited in this specification are incorporated herein by reference.

SYNTHETIC EXAMPLE

The synthesis of the couplers of the invention is accomplished using conventional reactions. The following is a typical method for preparing coupler Y-2 of the invention which may be employed in an analogous manner to prepare other couplers of the invention.

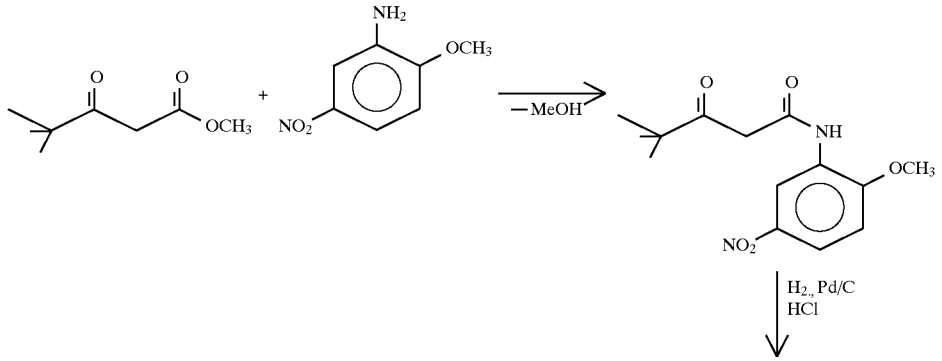

-continued

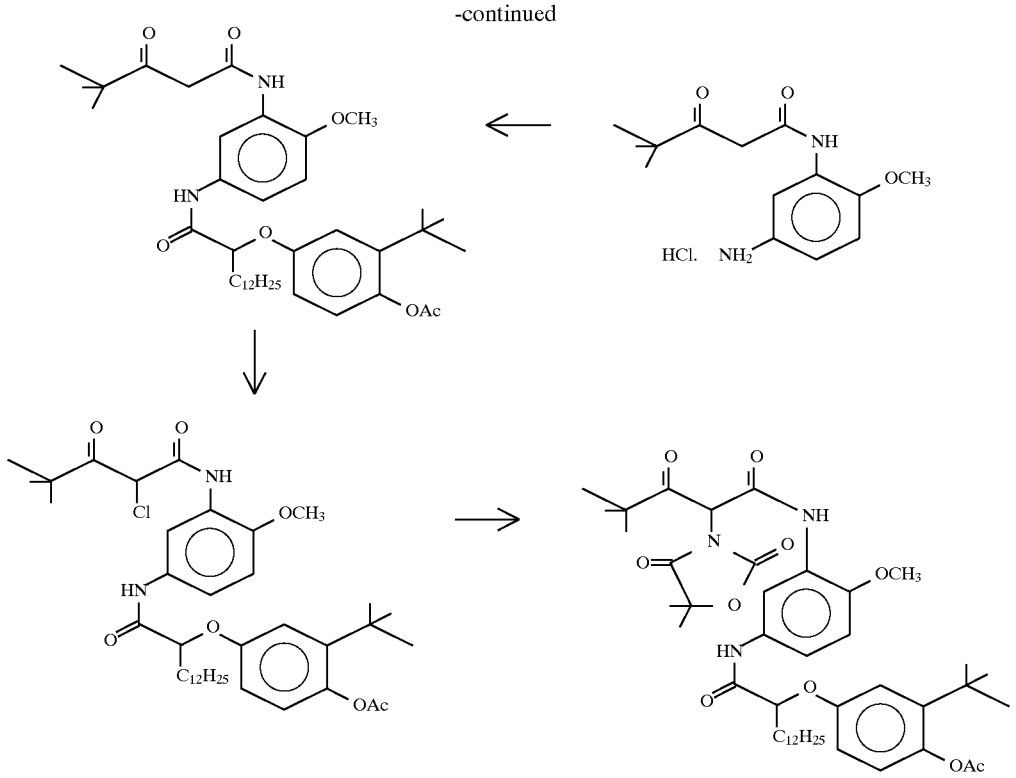

Synthesis of Example Yellow Coupler Y-2

Preparation of 2-(4,4-dimethyl-3-oxovaleramido)-4-nitroanisole.

Methyl-4,4-dimethyl-3-oxovalerate (15.8 g, 0.1 mol) and 2-methoxy-5-nitroaniline (16.8 g, 0.01 mol) were taken up in toluene (150 mL) in a round bottomed flask fitted with a Dean-Stark trap. The mixture was heated to a vigorous reflux while the MeOH side-product was distilled off and removed. After 4 hours, the mixture was cooled and the toluene removed in vacuo. The residue was recrystallized from acetonitrile to yield 27 g of the desired condensation product.

Preparation of 2-(4,4-dimethyl-3-oxovaleramido)-4-aminoanisole hydrochloride.

A solution of 2-(4,4-dimethyl-3-oxo-valeramido)-4-nitroanisole (20 g) in EtOH (100 mL) with 1 g Pd/C was catalytically reduced under hydrogen to give the corresponding amine in quantitative yield. After filtering the mixture, HCl gas was bubbled through the solution. Upon cooling, white crystals of 2-(4,4-dimethyl-3-oxo-valeramido)-4-aminoanisole hydrochloride formed. The crystals were collected and dried in vacuo to yield 17 g of product.

Preparation of 2-(4,4-dimethyl-3-oxovaleramido)-4-[2-dodecyl-2-(4-aceto-3-tert-butyl-aryloxy)acetamido]anisole.

A solution of 2-dodecyl-2-(4-aceto-3-tert-butylaryloxy)-acetylchloride (19.4 g, 0.043 mol) in acetonitrile (100 mL) was added to a solution of 2-(4,4-dimethyl-3-oxovaleramido)-4-aminoanisole hydrochloride (13.1 g, 0.043 mol) in acetonitrile (50 mL). Diisopropylethylamine (11.2 g, 0.086 mol) was added dropwise. After 1 hour, EtOAc (100 mL) was added. The mixture was submitted to an aqueous, acidic workup. The organics were dried over MgSO4, filtered and the solvents removed in vacuo. The isolated product (27 g) was suitably pure for use in the next step.

Preparation of 2-(2-chloro-4,4-dimethyl-3-oxovaleramido)-4-[2-dodecyl-2-(4-aceto-3-tert-butylaryloxy)acetamido]anisole.

To a solution of 2-(4,4-dimethyl-3-oxovaleramido)-4-[2-dodecyl-2-(4-aceto-3-tert-butylaryloxy)acetamido]anisole (25.0 g, 0.0367 mol) in dichloromethane (150 mL) was added sulfuryl chloride (2.9 mL, 0.0367 mol). The mixture was stirred for 30 minutes at room temperature. The solvent was removed in vacuo. The product was formed quantitatively and was suitably pure for use in the next reaction.

Preparation of 2-[4,4-dimethyl-2-(4,4-dimethyloxazolidinedione)-3-oxovaleramido]-4-[2-dodecyl-2-(4-aceto-3-tert-butylaryloxy)-acetamido]anisole.

A solution of 2-(2-chloro-4,4-dimethyl-3-oxovaleramido)-4-[2-dodecyl-2-(4-aceto-3-tert-butylaryloxy)-acetamido]anisole (15.0 g, 0.021 mol), 4,4-dimethyloxazolidinedione (3.4 g, 0.026 mol) and triethylamine (2.2 g, 0.023 mol) in acetonitrile (200 mL) was stirred and heated to reflux. After 4 hours, the mixture was cooled to room temperature and submitted to aqueous, acidic workup. The organics were extracted into EtOAc, dried over MgSO4, filtered and the solvent stripped in vacuo. The residue was recrystallized from isopropyl ether to yield 15.2 g (90%) of the desired yellow coupler. The results of NMR analysis were consistent with the compound Y-2. 1H NMR (CDC13/TMS): d=0.9 (t, 3 H), 1.4 (m, 46 H), 2.3 (s, 3H), 3.9 (s, 3 H), 4.6 (t, 1 H), 5.6 (s, 1 H), 6.9 (m, 4H), 7.8 (d, 1 H), 8.1 (m,br, 2 H), 9.0 (s, 1H).

MS (FDMS) m/e=807; C45 H65 N3 010

| | | | |
|---|---|---|---|
| calc | 66.89 | H 8.11 | N 5.2 |
| found | 66.85 | H 8.01 | N 5.0 |

PHOTOGRAPHIC EXAMPLES

Preparation of Photographic Elements

Dispersions of the couplers were prepared in the following manner, exemplified with representative coupler Y2. In one vessel, 1.55 g of the coupler, Y2, 0.72 g of dibutyl phthalate, 0.6 g of 2-(2-butoxyethoxy)ethyl acetate and 4.6g of ethylacetate were combined and warmed to 60° C. to dissolve. In a second vessel, 21.2 g of 11.55% gelatin, 2.44 g of Alkanol XC® (surfactant and trademark of E. I. Dupont Co., USA) and 9.62 g of water were combined and warmed to 40° C. The two mixtures were combined and passed three times through a Gaulin colloid mill.

The photographic elements were prepared by coating the following layers in the order listed on a resin-coated paper support:

| | |
|---|---|
| 1st layer | |
| Gelatin | 3.23 g/m$^2$ |
| 2nd layer | |
| Coupler dispersion | 8.8 × 10$^{-4}$ mole coupling moieties /m$^2$ |
| AgCl emulsion | 0.28 g Ag/m$^2$ and blue-sensitized |
| 3rd layer | |
| Gelatin | 1.4 g/m$^2$ |
| Bis (vinylsulfonylmethyl) ether | 0.14 g/m$^2$ |

Exposing and processing of Photographic Elements

The photographic elements were subjected to stepwise exposure to blue light and processed as follows at 35° C.:

Color Developer 45 seconds

Bleach-Fix 45 seconds

Wash (running water) 90 seconds

The developer and bleach-fix were of the following compositions:

| Developer | |
|---|---|
| Water | 700 mL |
| Triethanolamine | 12.41 g |
| Blankophor REU TM (Mobay Corp) | 2.3 g |
| Lithium polystyrene sulfonate (30%) | 0.3 g |
| N,N-diethylhydroxylamine (85%) | 5.4 g |
| Lithium sulfate | 2.7 g |
| N-(2-[(4-amino-3-methylphenyl)ethylamino] ethyl)-methanesulfonamide, sesquisulfate | 5.0 g |
| 1-hydroxyethyl-1,1-diphosphonic acid (60%) | 0.81 g |
| Potassium carbonate, anhydrous | 21.16 g |
| Potassium chloride | 1.6 g |
| Potassium bromide | 7.0 g |
| Water to make | 1.0 L |
| pH at 26.7° C. adjusted to 10.2 | |

-continued

| Bleach-Fix | |
|---|---|
| Water | 700 mL |
| Solution of Ammonium thiosulfate (56.4% plus Ammonium sulfite (4%) | 127.4 g |
| Sodium metabisulfite | 10.0 g |
| Acetic Acid (glacial) | 10.2 g |
| Solution of Ammonium ferric ethylene-diaminetetraacetate (44%) + ethylene-diaminetetraacetic acid (3.5%) | 110.4 g |
| Water to make | 1.0 L |
| pH at 26.7° C. adjusted to 6.7 | |

Photographic Tests

Yellow dyes were formed upon processing of the photographic elements. The coatings were assessed sensitometrically for the following characteristics:

D-max (the maximum density to blue light),

Dmin (the minimum density to blue light),

Contrast (the ratio of (S-T)/0.6 where S is the density at a log exposure 0.3 units greater than the Speed value, and T is the density at a log exposure 0.3 units less than the Speed value), Speed (the relative reciprocal of exposure required to yield a density to blue light of 1.0), and Lambda-max (the wavelength of peak absorption at a density of 1.0).

The data is reported in Table I. The data shows that the couplers of the invention are comparable or superior in sensitometry to the comparison couplers.

TABLE I

Sensitometric Data

| Coupler | Type | Dmax | Dmin | Contrast | Speed | 1max |
|---|---|---|---|---|---|---|
| Y-1 | Inv | 2.75 | 0.06 | 2.65 | 182.4 | 439 |
| Y-2 | Inv | 2.75 | 0.09 | 2.65 | 188.4 | 439 |
| Y-3 | Inv | 2.74 | 0.08 | 2.64 | 198.1 | 438 |
| Y-4 | Inv | 2.76 | 0.09 | 2.80 | 199.5 | 437 |
| Y-5 | Inv | 2.83 | 0.05 | 2.84 | 186.9 | 436 |
| Y-6 | Inv | 2.81 | 0.08 | 2.59 | 197.0 | 440 |
| C-1 | Comp | 2.70 | 0.05 | 2.55 | 191.7 | 446 |
| C-2 | Comp | 2.62 | 0.05 | 2.60 | 188.2 | 438 |
| C-3 | Comp | 2.42 | 0.06 | 2.40 | 177.6 | 441 |
| C-4 | Comp | 2.71 | 0.04 | 2.51 | 178.4 | 442 |

The comparative coupers were as follows:

C-1

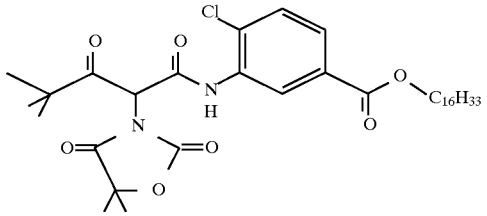

-continued

C-2

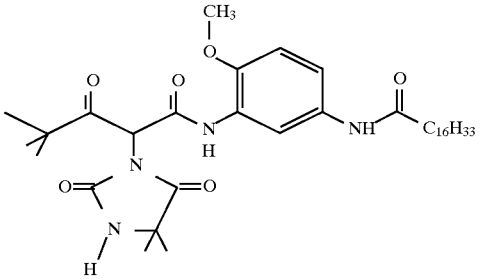

C-3

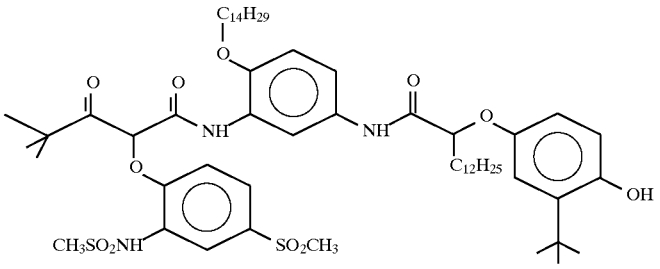

C-4

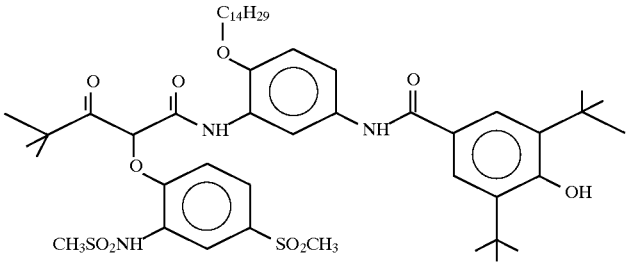

Light Stability Test

The coating strips were exposed to a high intensity Xenon light source at a luminous flux level of 50 Klux with a WRATTEN 2C filter interposed between the light source and sample. After 2 weeks and 4 weeks, the strips were removed and the decrease in density from initial densities of 1.7, 1.0 and 0.5 were measured. The data is recorded in Table 2 as a measure of the per cent dye retained for each sample dye. These results compare the light fastness of dyes from couplers of the present invention with those of the prior art.

TABLE II

| | | Dye Retained from Initial Density 1.0 | |
|---|---|---|---|
| Coupler | Type | 14-Day | 28-Day |
| Y-1 | Inv | 96% | 85% |
| Y-2 | Inv | 96% | 86% |
| Y-3 | Inv | 91% | 79% |
| Y-4 | Inv | 91% | 82% |
| Y-5 | Inv | 94% | 79% |
| Y-6 | Inv | 95% | 85% |
| C-1 | Comp | 51% | 17% |
| C-2 | Comp | 72% | 40% |
| C-3 | Comp | 78% | 40% |
| C-4 | Comp | 91% | 77% |

As can be seen from Table II, the couplers of the invention have superior light fastness as compared to couplers typically used in the art. The amount of dye remaining after exposure averages 82.6% for the inventive couplers compared to an average of 43.5% for the comparative couplers. At 14 days the corresponding values are 93.8 and 73.0, respectively. The inventive couplers are stable enough that they can be used without light stabilizing addenda when a neutral fade position with typical magenta and cyan dyes is desired.

Neutral fade could also be achieved even if extremely stable magenta and cyan dyes were utilized by incorporating light stabilizing addenda along with the yellow couplers of this invention in an analogous photographic format to that described above with the following weight ratios: Yellow coupler:coupler solvent such as dibutylphthalate:auxiliary solvent such as 2-(2-butoxyethoxy)ethylacetate:stabilizer addenda 54:15:18:13. The stabilizer addenda typically used are those exemplified by compounds 1–3 but are not limited to these. Also suitable are polymeric stabilizing addenda. The polymers can be homopolymers or copolymers which are miscible with the coupler and coupler solvent which are present, for example, as a latex or as an organic solution. Especially useful are polymers containing monomers derived from styrene and/or acrylics such as acrylamide (particularly t-butyl acrylamide such as P1 below where x=99 and y=1), acrylates, methacrylamides, and methacrylates.

Table III describes 2-week and 4-week light fade data for dyes formed from representative couplers using compound 1 as stabilizing addenda.

Compound 1

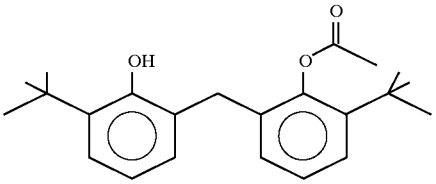

Compound 2

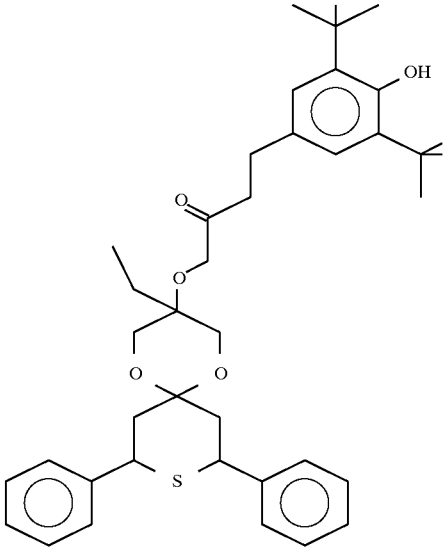

Compound 3

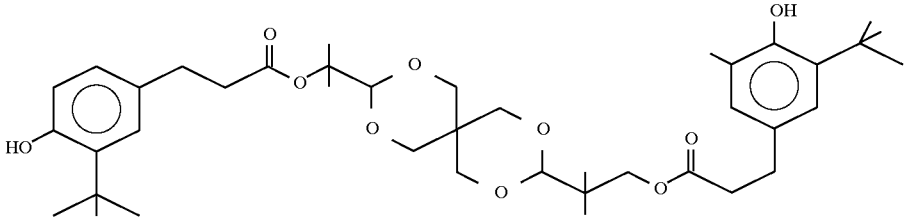

P1

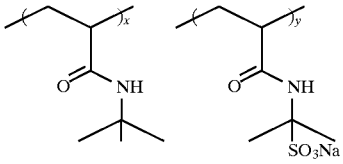

ADD-1

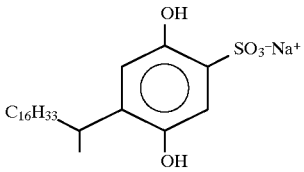

TABLE III

| Coupler + Compound 1 | | | |
|---|---|---|---|
| | | Dye Retained from Initial Density 1.0 | |
| Coupler | Type | 14-Day | 28-Day |
| Y-1 | Inv | 97% | 90% |
| Y-2 | Inv | 100% | 93% |
| Y-3 | Inv | 96% | 86% |
| Y-4 | Inv | 93% | 84% |
| Y-5 | Inv | 93% | 90% |
| Y-6 | Inv | 95% | 85% |
| C-1 | Comp | 88% | 69% |
| C-3 | Comp | 91% | 71% |

As shown in Table III, the couplers of this invention yield dyes which show highly superior resistance to light fade when coated with stabilizing addenda.

This can be particularly useful if one desires to use certain emulsion additives to achieve unique photographic features, as is sometimes done in the art. Although the presence of these emulsion additives give desirable photographic features, they can sometimes be detrimental to dye stability. Coupler Y-2 was coated in a format similar to that described above with the weight ratio of coupler:dibutylphthalate:stabilizing addenda of 3:2:1. Emulsion addenda ADD-1 was present in the emulsion in the amount of 0.88 mg/ft$^2$. The data in Table IV thus show that coupler Y-2 is still quite stable even without stabilizing addenda and can be made even more stable in the presence of stabilizing addenda.

TABLE IV

| Dye Retained from Initial Density 1.0 Coupler + Addenda Emulsion with ADD-1 | | | |
|---|---|---|---|
| Coupler | Type | Addenda | 21 days |
| C-2 | Comp | None | 53% |
| Y-2 | Inv | None | 77% |
| C-2 | Comp | Cmpd. 1 | 75% |
| Y-2 | Inv | Cmpd. 1 | 84% |
| C-2 | Comp | Cmpd. 2 | 74% |
| Y-2 | Inv | Cmpd. 2 | 87% |
| C-2 | Comp | Cmpd. 3 | 74% |
| Y-2 | Inv | Cmpd. 3 | 87% |
| C-2 | Comp | p1 | 74% |
| Y-2 | Inv | p1 | 80% |

Dye Dark Stability Tests

A further comparison was conducted to compare the dye dark stability of a dye formed by an element of the invention to that of a dye formed with a coupler similar to that of the invention but having a different coupling-off group. Samples were prepared, exposed, and processed in the same manner as for the preceding photographic tests. Then the samples were placed in an oven at 60° C. and 50% relative humidity for 4 and 8 weeks and the % dye retained was measured. The results were as follows:

TABLE V

Dye Retained Under Humid Dark Storage Conditions

| | | 4 Weeks at 60° C./50% RH | | 8 Weeks at 60° C./50% RH | |
|---|---|---|---|---|---|
| Coupler | Type | Density Retained from 1.0 | Density Retained from 1.7 | Density Retained from 1.0 | Density Retained from 1.7 |
| C-5 | Comp | 0.99 | 1.69 | 0.58 | 1.02 |
| Y-35 | Inv | 0.99 | 1.66 | 0.97 | 1.61 |

Comparison C-5 had the formula:

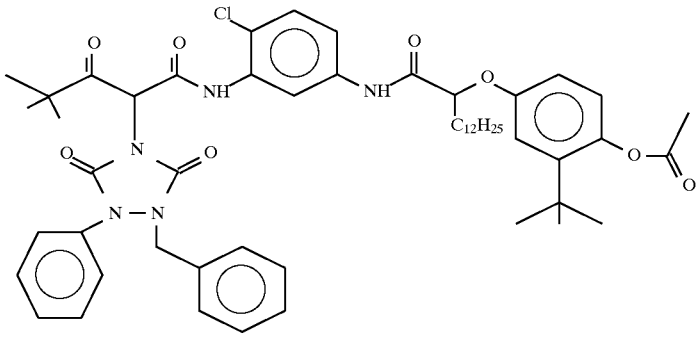

C-5

The data shows that the dark stability of the resulting dye from the inventive element after 8 weeks is far superior to that of the comparison element containing a coupling-off group containing three nitrogen atoms in the ring. The comparison lost about 40% of the density while the inventive sample lost only about 5–10%.

What is claimed is:

1. A photographic element comprising a light sensitive silver halide emulsion layer having associated therewith an open chain α-carbonyl acetanilide yellow dye-forming coupler having the formula:

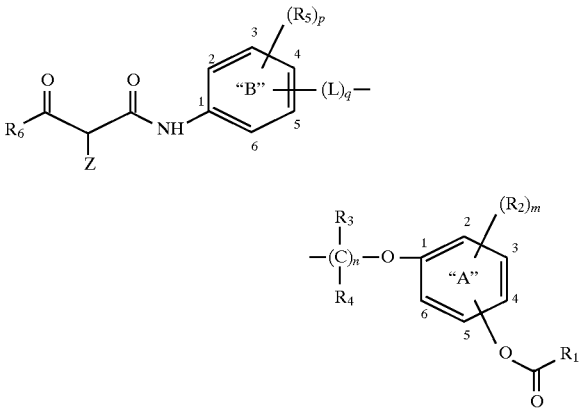

wherein $R_1$ is selected from the group consisting of alkyl, aryl, heterocyclic, and amino groups, provided that $R_1$ may form a ring bonded to another carbon atom which is a member of Ring "A";

each $R_2$ is independently selected from the group consisting of those substituents having a Hammett's sigma value of 0 or less, and m is from 0 to 4;

each $R_3$ and $R_4$ for each of the n carbon atoms is independently selected from the group consisting of hydrogen, alkoxy, aryl, heterocyclic, aryloxy, and alkyl groups, and n is 0 to 16;

each $R_5$ is independently selected from the group consisting of halogen, amino, alkyl groups, and groups linked to the "B" ring by oxygen or sulfur, and p is 0 to 3, provided that two $R_5$ groups may join to form a ring;

ring each L is independently a divalent linking group selected from the group consisting of

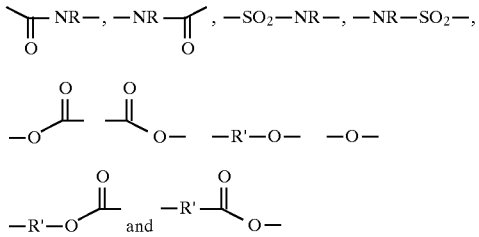

wherein R is hydrogen or an alkyl group and R' is an alkylene group and q is 0 to 3;

Ring "A" is bonded indirectly to the 3-, 4-, or 5-position of Ring "B";

$R_6$ is selected from the group consisting of alkyl, aryl, and amino groups; and Z is hydrogen, or a group capable of coupling-off when the coupler reacts with an oxidized color developing agent said coupling-off group selected from the group consisting of:

(a) an arylthio group;

(b) a heterocyclic group containing, in a five or six membered ring, one or two nitrogen atoms, wherein the group Z is bonded to the remainder of the coupler through a nitrogen atom in the ring; and (c) a benzotriazole group wherein the group Z is bonded to the remainder of the coupler through a nitrogen atom in the triazole group.

2. The element of claim 1 wherein m is at least 1.

3. The element of claim 2 wherein there is at least one $R_2$ substituent on ring "A" ortho to the acyloxy group to which $R_1$ is attached.

4. The element of claim 3 wherein said at least one $R_2$ substituent on ring "A" ortho to the acyloxy group to which $R_1$ is attached contains branching.

5. The element of claim 4 wherein said at least one $R_2$ substituent on ring "A" ortho to the acyloxy group to which $R_1$ is attached is a branched alkyl group.

6. The element of claim 5 wherein said at least one $R_2$ substituent on ring "A" ortho to the acyloxy group to which $R_1$ is attached contains at least 3 carbon atoms.

7. The element of claim 6 wherein said at least one $R_2$ substituent on ring "A" ortho to the acyloxy group to which $R_1$ is attached is selected from the group consisting of i-propyl, t-butyl, t-amyl, t-octyl, and adamantyl groups.

8. The element of claim 1 wherein $R_1$ contains at least 4 carbon atoms.

9. The element of claim 1 wherein at least one $R_5$ is bonded at the 2-,4-, or 6-position of ring "B".

10. A photographic element comprising a light sensitive silver halide emulsion layer having associated therewith an open chain α-carbonyl acetanilide yellow dye-forming coupler having the formula:

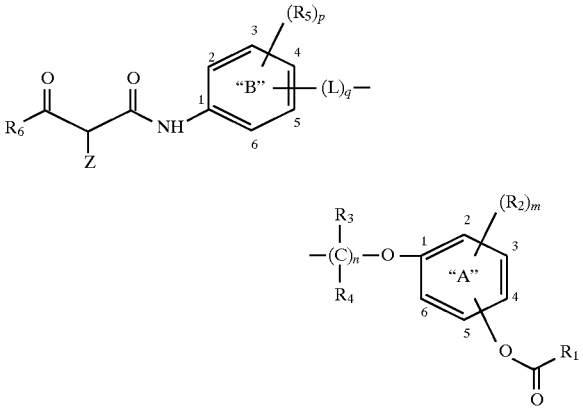

wherein $R_1$ is selected from the group consisting of alkyl, aryl, heterocyclic, and amino groups, provided that $R_1$ may form a ring bonded to another carbon atom which is a member of Ring "A";

each $R_2$ is independently selected from the group consisting of those substituents having a Hammett's sigma value of 0 or less, wherein there is at least one $R_2$ substituent on ring "A" ortho to the acyloxy group to which $R_1$ is attached, and m is from 1 to 4;

each $R_3$ and R4 for each of the n carbon atoms is independently selected from the group consisting of hydrogen, alkoxy, aryl, heterocyclic, aryloxy, and alkyl groups, and n is 0 to 16;

each $R_5$ is independently selected from the group consisting of halogen, amino, alkyl groups, and groups linked to the "B" ring by oxygen or sulfur, and p is 0 to 3, provided that two $R_5$ groups may join to form a ring;

each L is independently a divalent linking group and q is 0 to 3;

Ring "A" is bonded indirectly to the 3-, 4-, or 5-position of Ring "B";

$R_6$ is selected from the group consisting of alkyl, aryl, and amino groups; and Z is hydrogen, or a group capable of coupling-off when the coupler reacts with an oxidized color developing agent said coupling-off group selected from the group consisting of:

(a) an arylthio group;

(b) a heterocyclic group containing, in a five or six membered ring, one or two nitrogen atoms, wherein the group Z is bonded to the remainder of the coupler through A nitrogen atom in the ring; and (c) a benzotriazole group wherein the group Z is bonded to the remainder of the coupler through a nitrogen atom in the triazole group.

11. The element of claim 10 wherein q is at least 1 and each L comprises a member selected from the group consisting of:

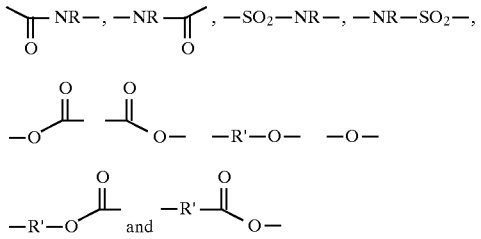

wherein R is hydrogen or an alkyl group and R' is an alkylene group.

12. The element of claim 10 wherein said at least one $R_2$ substituent on ring "A" ortho to the acyloxy group to which $R_1$ is attached contains branching.

13. The element of claim 12 wherein said at least one $R_2$ substituent on ring "A" ortho to the acyloxy group to which $R_1$ is attached is a branched alkyl group.

14. The element of claim 13 wherein said at least one $R_2$ substituent on ring "A" ortho to the acyloxy group to which $R_1$ is attached is selected from the group consisting of i-propyl, t-butyl, t-amyl, t-octyl, and adamantyl groups.

15. The element of claim 13 wherein $R_1$ contains at least 4 carbon atoms.

16. The element of claim 10 wherein at least one $R_5$ is bonded at the 2-,4-, or 6-position of ring "B".

17. A process for forming a color image comprising imagewise exposing an element as desribed in claim 1 and then contacting the element with a color developing agent.

* * * * *